US007593625B2

(12) United States Patent
Kamikawa et al.

(10) Patent No.: US 7,593,625 B2
(45) Date of Patent: Sep. 22, 2009

(54) FLUID HEATING APPARATUS

(75) Inventors: Yuji Kamikawa, Tosu (JP); Mikio Nakashima, Tosu (JP); Osamu Tsuda, Tosu (JP)

(73) Assignee: Tokyo Electron Limited, Tokyo (JP)

( * ) Notice: Subject to any disclaimer, the term of this patent is extended or adjusted under 35 U.S.C. 154(b) by 294 days.

(21) Appl. No.: 11/481,253

(22) Filed: Jul. 6, 2006

(65) Prior Publication Data

US 2007/0017502 A1 Jan. 25, 2007

(30) Foreign Application Priority Data

Jul. 8, 2005 (JP) ..... 2005-199899

(51) Int. Cl.
*F24F 3/14* (2006.01)
*H05B 3/40* (2006.01)

(52) U.S. Cl. ..... 392/393; 392/478

(58) Field of Classification Search ..... 392/478–503, 392/386–398
See application file for complete search history.

(56) References Cited

U.S. PATENT DOCUMENTS 1,767,122 A * 6/1930 Dean ..... 392/492
3,546,431 A 12/1970 Gibbs
5,054,107 A 10/1991 Batchelder
5,127,465 A * 7/1992 Fischer ..... 165/263
5,559,924 A * 9/1996 Kadotani et al. ..... 392/483
6,236,810 B1 5/2001 Kadotani
2003/0026603 A1 2/2003 Castaneda et al.
2004/0184794 A1 9/2004 Johnson et al.

FOREIGN PATENT DOCUMENTS

JP 09-210577 8/1997
WO WO 91/03915 3/1991
WO 2004/053400 6/2004

OTHER PUBLICATIONS

Chinese Office Action issued on Nov. 2, 2007.

* cited by examiner

*Primary Examiner*—Sang Y Paik
(74) *Attorney, Agent, or Firm*—Smith, Gambrell & Russell, LLP

(57) ABSTRACT

Disclosed is a fluid heating apparatus including a halogen lamp 23, and a tubular structure 26 surrounding the heating lamp and having a fluid inlet 24 and a fluid outlet 25. The tubular structure 26 comprises plural straight pipes 26*a* arrayed circumferentially around the halogen lamp 26, with adjacent straight pipes 26*a* being in contact with each other, or being slightly spaced from each other. At least the surfaces, facing the halogen lamp 26, of the straight pipes 26*a* are coated with a black paint 27, or a radiant-light-absorbing paint.

9 Claims, 7 Drawing Sheets

FLUID HEATING APPARATUS

TECHNICAL FIELD

The present invention relates to a fluid heating apparatus, and more specifically to a fluid heating apparatus that heats a flowing fluid by thermal radiation emitted from a heating lamp.

BACKGROUND ART

A semiconductor device fabricating process includes a fluid treatment that brings a process object, such as a semiconductor wafer, into contact with a processing fluid to treat the process object. In one example of the fluid treatment, the process object is immersed in a processing fluid, such as diluted hydrofluoric acid (DHF) or a rinse liquid, held in a cleaning tank in order to clean the process object. In another example of the fluid treatment, a mixed gaseous fluid of vaporized isopropyl alcohol (IPA) and nitrogen gas ($N_2$ gas) is supplied to a process object to dry the same. In general, the temperature of the processing fluid must be regulated at a designated target temperature in order to achieve the desired process result. To this end, a fluid heating apparatus for regulating the temperature of the processing fluid is employed.

JP09-210577A discloses such a fluid heating apparatus. The fluid heating apparatus includes a heating lamp, a transparent quartz tube surrounding the heating lamp, and a tubular container surrounding the transparent quartz tube to define a fluid-flowing space between the transparent quartz tube and the tubular container. The fluid supplied into the fluid-flowing space through a fluid inlet flows through the fluid-flowing space, where the fluid is heated by the thermal radiation emitted from the heating lamp, and flows out of the fluid-flowing space through a fluid outlet. In this fluid heating apparatus, the fluid is exposed to the thermal radiation emitted from the heating lamp and transmitted through the transparent quartz tube so that the fluid absorbs the energy of the thermal radiation to be heated. To put it briefly, the fluid is "directly" heated by the thermal radiation.

In general, a fluid heating apparatus of the foregoing direct-heating type has some problems. First, if the thermal-radiation absorption of the fluid is high, the fluid flowing through an area, remote from the heating lamp, in the fluid-flowing space is not sufficiently heated, while the fluid flowing through an area, near the heating lamp, in the fluid-flowing space is efficiently heated. Thus, sufficient heating efficiency can not be achieved. If the fluid is a flammable or volatile organic solvent such as IPA, the fluid must be heated with particular attention on the temperature control.

The fluid heating apparatus of JP09-210577A is further provided with plural metallic fins for heating a fluid of low thermal-radiation absorption. The metallic fins are circumferentially arrayed in the fluid-flowing space and extend in the fluid-flowing direction. If the thermal-radiation absorption of the fluid is low, the thermal radiation emitted from the heating lamp falls on the metallic fins to heat the same. The fluid is heated by the heat transfer from the metallic fins to the fluid. The fin structure is complicated, and thus costly.

As mentioned above, in a fluid heating apparatus of the foregoing direct-heating type, the transparent tube surrounding the heating lamp is typically made of quartz. If the fluid to be heated is DHF, the quartz material contacting with the fluid will be dissolved therein, and thus cannot be used.

SUMMARY OF THE INVENTION

The present invention has been made in view of the forgoing problems, and therefore the main object of the present invention is to provide a fluid heating apparatus which is capable of effectively and uniformly heating a fluid, and which can be fabricated at a reasonable cost. Preferably, the fluid heating apparatus can heat any sort of fluid.

In order to achieve the above objective, the present invention provides a fluid heating apparatus, which includes: a heating lamp; and a tubular structure having a fluid inlet allowing the fluid to be heated to flow into the tubular structure and a fluid outlet allowing the fluid having been heated to flow out of the tubular structure, wherein the tubular structure comprises at least one pipe arranged in a form of a tube surrounding the heating lamp, and at least a surface, facing the heating lamp, of the tubular structure is coated with a radiant-light-absorbing paint.

According to the present invention, the radiant-light-absorbing paint efficiently absorbs thermal radiation emitted from the heating lamp, the pipe is heated efficiently, and thus the fluid flowing through the pipe is heated efficiently through the heat transfer from the pipe to the fluid. The fluid is thus efficiently heated regardless of the sort of the fluid, or the thermal-radiation absorption of the fluid.

Each of said at least one pipe may have an inner surface formed of a chemical-resistant synthetic resin. In this case, preferably, each of said at least one pipe may have a heat-conductive layer formed of a heat-conductive material, and the radiant-light-absorbing paint may be coated on the heat-conductive layer.

As the inner surface is formed of the chemical-resistant synthetic resin, a corrosive fluid can be heated without damaging the pipe. If the heat-conductive layer is provided, the heat generated in the radiant-light-absorbing paint due to the absorption of the thermal radiation is uniformly transferred to and distributed over the inner surface formed of the chemical-resistant synthetic resin through the heat-conductive layer, and thus the fluid can be heated uniformly, even if the inner surface is formed of the chemical-resistant synthetic resin having relatively low heat conductivity.

In one preferable embodiment, the tubular structure may comprise a plurality of straight pipes circumferentially arrayed around the heating lamp. In another preferable embodiment, the tubular structure may comprise a single pipe wound in a spiral configuration around the heating lamp.

The fluid heating apparatus may further include a tubular container accommodating the heating lamp and the tubular structure. The tubular container may have a light-reflective inner surface.

Due to the provision of the tubular container, dissipation of the thermal energy generated by the heating lamp can be suppressed, improving the heating efficiency. As the radiant light emitted from the heating lamp and leaked through gaps (if any) in the tubular structure is reflected by the light-reflective inner surface of the tubular container to fall on the outer surface of the tubular structure, the fluid can be heated more efficiently.

The fluid heating apparatus may further include an inert gas supply adapted to supply an inert gas into an interior of the tubular container. This configuration prevents penetration of external atmosphere into the tubular container, and achieves safer operation of the fluid heating apparatus.

The fluid heating apparatus may further include: a temperature sensor adapted to detect temperature of a fluid flowing through the tubular structure; a power supply adapted to regulate electric power to be supplied to the heating lamp, thereby to control calorific power generated by the heating lamp; a controller configured to generate a control signal based on the temperature detected by the temperature sensor and send the control signal to the power supply so that the temperature of the fluid coincides with a target value.

DESCRIPTION OF THE PREFERRED EMBODIMENTS

First Embodiment

A fluid heating apparatus in a first embodiment of the present invention and a cleaning system equipped with the fluid heating apparatus will be described with reference to FIGS. 1, 2, 3A and 3B.

Figure 1:
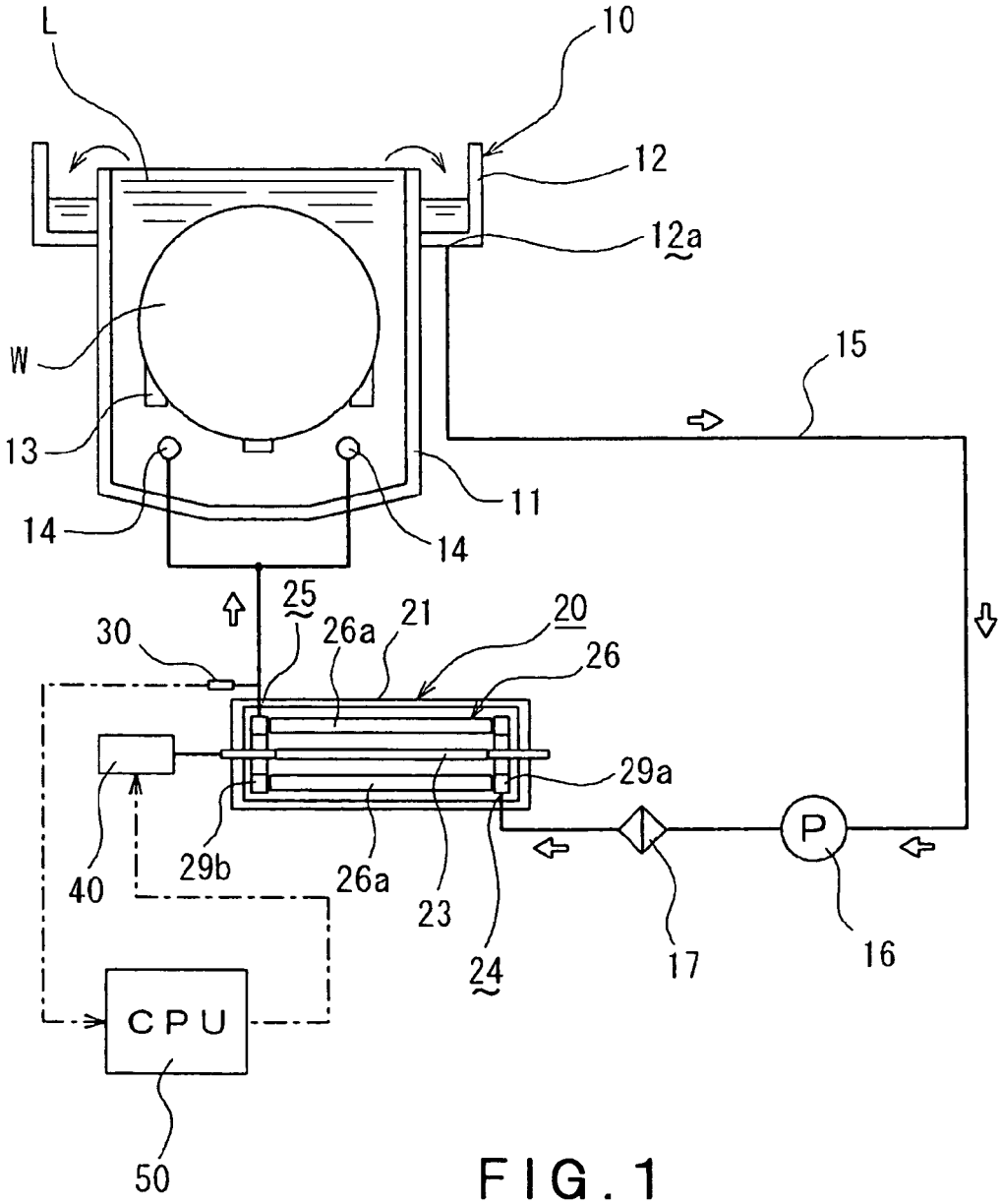
FIG. 1 is a schematic diagram showing the whole structure of a cleaning system equipped with a fluid heating apparatus in a first embodiment of the present invention.

Referring to FIG. 1, the cleaning system includes: a cleaning tank 10 having an inner tank 11 that holds a cleaning liquid L, such as diluted hydrofluoric acid (DHF) or a rinse liquid (e.g., deionized water), and an outer tank 12 surrounding the upper opening of the inner tank 11 to receive the cleaning liquid overflowing from the inner tank 11; cleaning liquid supply nozzles 14 arranged at a lower area of the interior of the inner tank 11; a circulation passage 15 having a first end connected to the cleaning liquid supply nozzles 14 and a second end connected to a drain port 12*a* arranged at a bottom of the outer tank 12. A circulation pump 16, a filter 17 and a fluid heating apparatus 20 are arranged in the circulation passage 15 in that order from the drain-port 12*a* side. A wafer boat 13 is arranged in the inner tank 11 to hold a plurality of (e.g., 50 pcs.) semiconductor wafers W (hereinafter simply referred to as "wafer"). A drain pipe (not shown) provided thereon with a drain valve (not shown) is connected to a bottom of the inner tank 11. A cleaning liquid source (not shown) is arranged to supply a cleaning liquid L to the outer tank 12.

Figure 2:
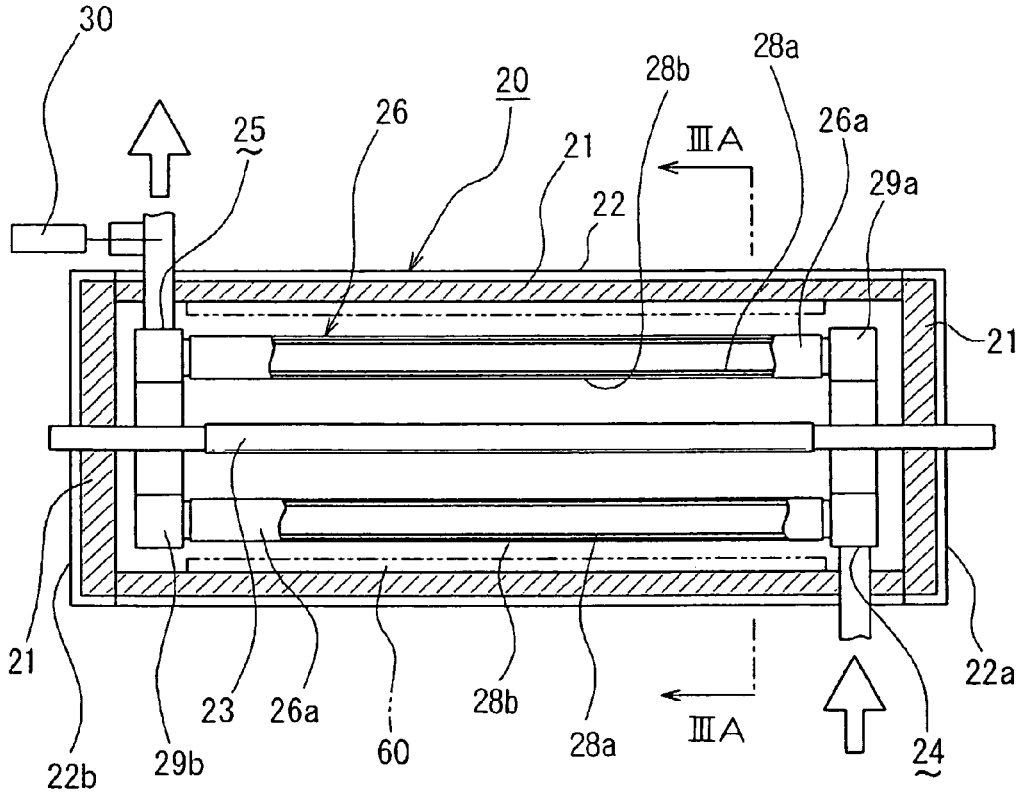
FIG. 2 is a longitudinal cross-sectional view of the fluid heating apparatus in the first embodiment of the present invention.
Figure 3A:
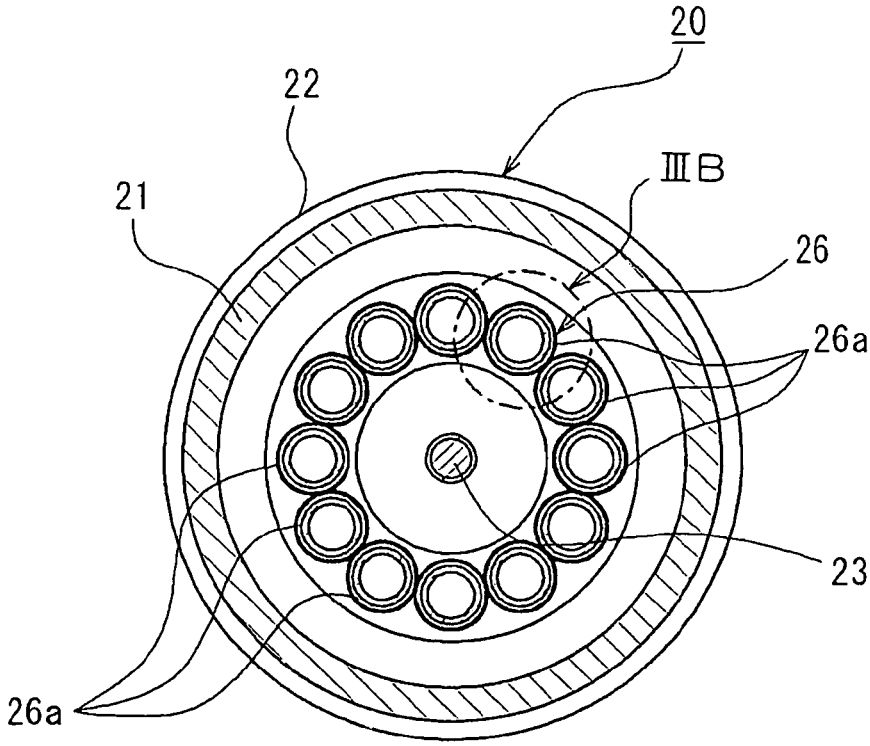
FIG. 3A is a transverse cross-sectional view of the fluid heating apparatus taken along line IIIA-IIIA in FIG. 2.
Figure 3B:
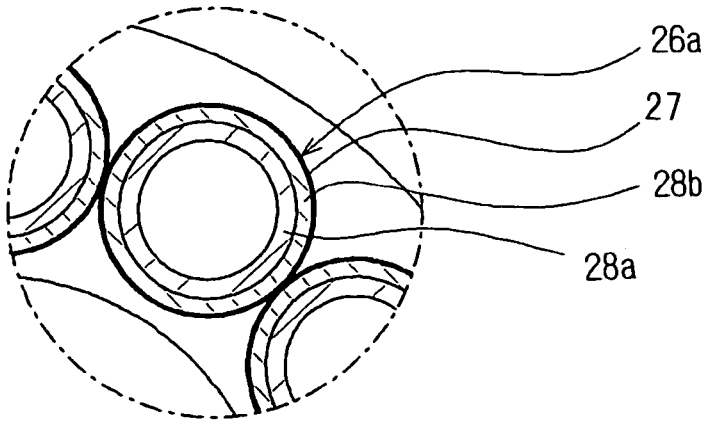
FIG. 3B is an enlarged view of area IIIB in FIG. 3A.
Figure 4A:
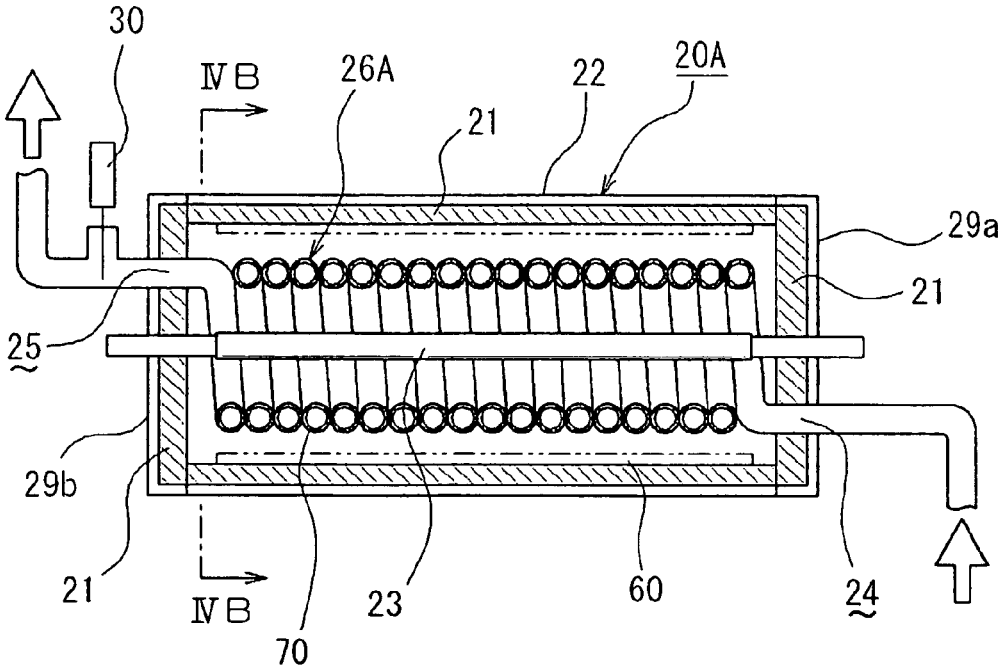
FIG. 4A is a longitudinal cross-sectional view of a fluid heating apparatus in a second embodiment of the present invention.
Figure 4B:
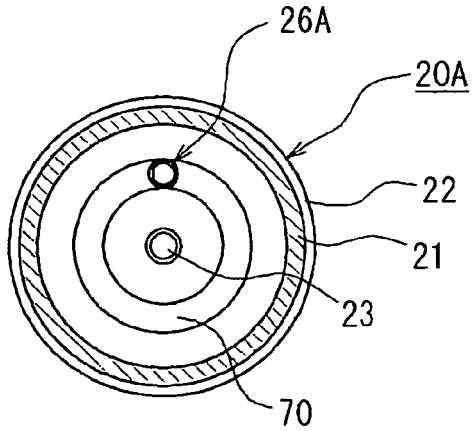
FIG. 4B is a transverse cross-sectional view of the fluid heating apparatus taken along line IVB-IVB in FIG. 4A.
Figure 5A:
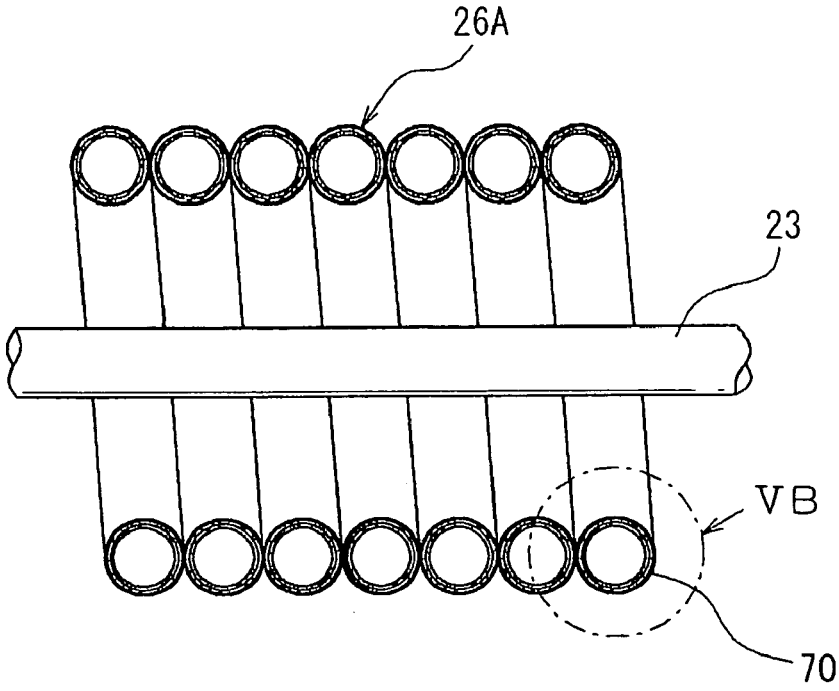
FIG. 5A is an enlarged view of the lamp and the pipe shown in FIG. 4A.
Figure 5B:
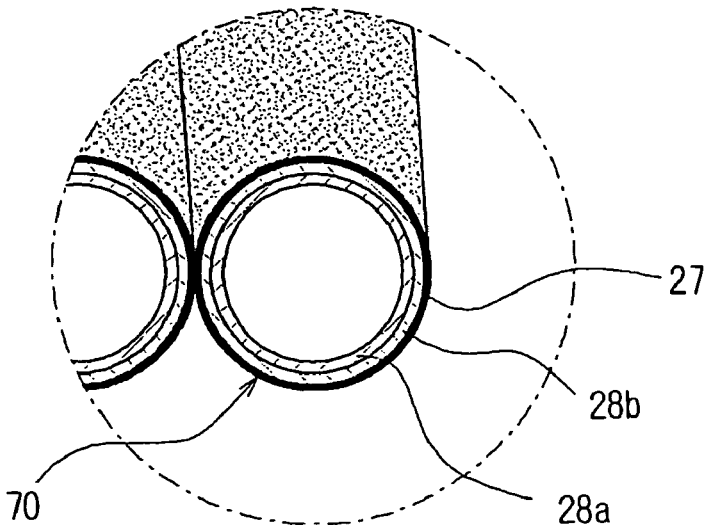
FIG. 5B is an enlarged view of area VB in FIG. 5A.
Figure 6A:
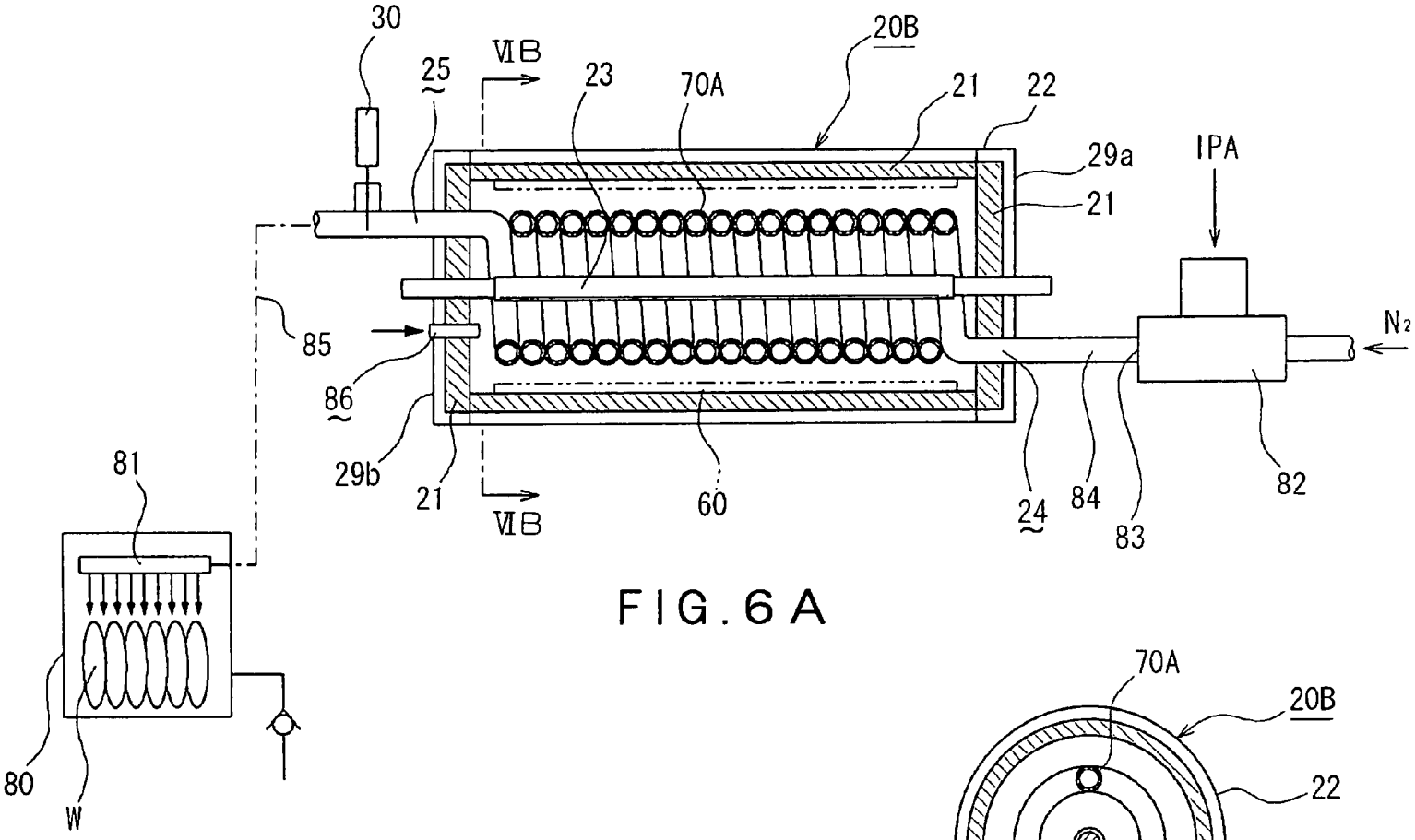
FIG. 6A is a schematic diagram showing the structure of an IPA drying system equipped with a fluid heating apparatus in a third embodiment of the present invention.
Figure 6B:
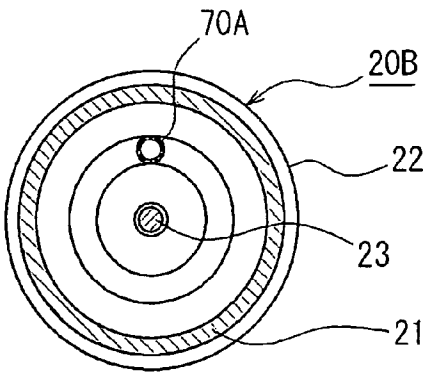
FIG. 6B is a cross sectional view of the heating apparatus taken along line VIB-VIB in FIG. 6A.
Figure 7A:
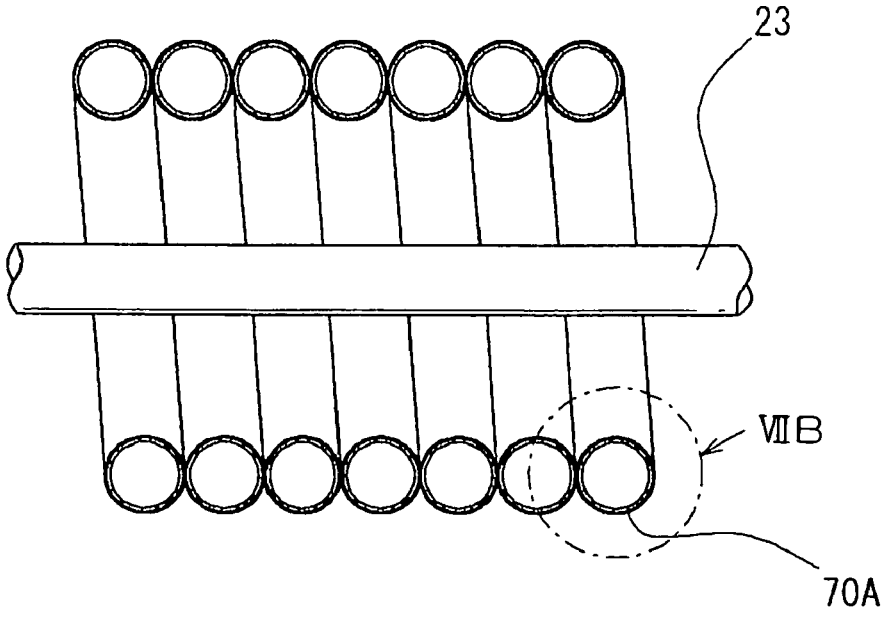
FIG. 7A is an enlarged view of the lamp and the pipe shown in FIG. 6A.
Figure 7B:
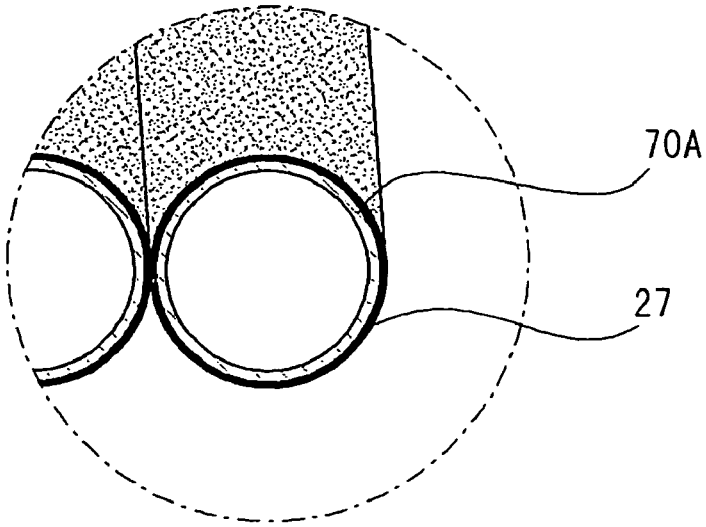
FIG. 7B is an enlarged view of area VIIB in FIG. 7A.

Referring to FIGS. 2, 3A and 3B, the fluid heating apparatus 20 includes a tubular container 22, which may be formed of a stainless steel. A heat-insulating material is arranged on inner surfaces of the tubular container 22. A heating lamp, typically a halogen lamp 23, is arranged in the tubular container 22 and extends along the longitudinal axis of the tubular container 22. A tubular structure 26 is arranged in the tubular container 22 to surround the halogen lamp 23 with an annular gap being formed between the halogen lamp 23 and the tubular structure 26. The tubular structure 26 has a fluid inlet 24 and a fluid outlet 25. The end openings of the tubular container 22 are respectively covered with end caps 22*a* and 22*b* each provided thereon with a heat-insulating material.

In the first embodiment, the tubular structure 26 comprises a plurality of straight pipes 26*a* circumferentially arrayed around the halogen lamp 23 to be in a form of a tube. Each of the straight pipes 26*a* extends parallel to the halogen lamp 23. In view of heating efficiency, circumferentially adjacent pipes 26*a* are preferably in close contact with each other, but may be in close proximity while remaining a slight gap therebetween as long as leakage of radiant light (thermal radiation) emitted from the halogen lamp 23 to the exterior of the tubular structure 26 can be prevented or suppressed to a negligible level. At least a portion, facing the halogen lamp 23, of each pipe 26*a* is coated with a radiant-light-absorbing paint, typically a black paint 27. In the illustrated embodiment, the whole surface of each pipe 26*a* is coated with the black paint 27.

As shown in FIGS. 3A and 3B, each pipe 26*a* has a two-layer structure and thus includes an inner layer 28*a* and an outer layer 28*b*. The inner layer 28*a* is formed of a chemical-resistant material, specifically a synthetic resin such as polytetrafluoroethylene, which is not dissolved in hydrofluoric acid. Thus, the pipe 26*a* has an inner surface of a chemical-resistant synthetic resin. The outer layer 28*b* is formed of a heat-conductive material such as a metallic material (e.g., aluminum or a stainless steel). The black paint 27 is coated on the heat-conductive outer layer 28*b*.

Due to the foregoing structure, the black paint 27 efficiently absorbs radiant light (thermal radiation) emitted from the halogen lamp 23, so that the black paint 27 is heated efficiently. The heat is transferred from the black paint 27 to the inner layer 28*a* through the heat-conductive outer layer 28*b* uniformly. Thus, the fluid flowing through each pipe 26*a* can be heated uniformly and efficiently.

The both ends of each pipe 26*a* are respectively connected to ring-shaped manifolds 29*a* and 29*b*. In this embodiment, the tubular structure 26 is composed of the pipes 26*a* and the manifolds 29*a* and 29*b*. The manifold 29*a* has a fluid inlet 24 serving as the fluid inlet of the tubular structure 26; and the manifold 29*b* has a fluid outlet 25 serving as the fluid outlet of the tubular structure 26. A part of the circulation passage 15 upstream of the tubular structure 26 connected to the filter 17 passes through one end of the tubular container 22 and is connected to the fluid inlet 24 of the manifold 29*a*; while a part of the circulation passage 15 downstream of the tubular structure 26 connected to the cleaning liquid nozzle 14 passes through the other end of the tubular container 22 and is connected to the fluid outlet 25 of the manifold 29*b*.

Arranged near the fluid outlet 25 of the tubular structure 26 is a temperature sensor 30, which measures temperature of a cleaning liquid L flowing out of the fluid outlet 25. A power regulator 40 is electrically connected to the halogen lamp 23 to control calorific power generated by the halogen lamp 23. The temperature sensor 30 and the power regulator 40 are electrically connected to a central processing unit (CPU) 50. Temperature measured by the temperature sensor 30 is sent to the CPU 50, and the CPU 50 send a control signal to the power regulator 50, so that the temperature of the cleaning liquid L is controlled to coincide with a target temperature such as 80° C.

A light-reflective member 60 may be arranged on the inner surface of the tubular container 22, as shown by chain-dotted lines in FIG. 2. Thus, radiant light emitted from the halogen light 23 and passed through gaps (if any) between adjacent pipes 26*a* is reflected by the light-reflective member 60 to fall on the outer surface of the tubular structure 26, so that the tubular structure 26 is more efficiently heated.

In operation, the circulation pump 15 is driven, so that a cleaning liquid L overflowing from the inner tank 11 flows through the circulation passage 15 to be supplied into the tubular structure 26 through the fluid inlet 24. Radiant light emitted by the halogen lamp 23 is absorbed by the black paint 27 coated on each straight pipe 26*a* of the tubular structure 26, and the absorbed heat is transmitted to the whole inner surface of each straight pipe 26*a* uniformly. Thus, the cleaning liquid L flowing through each straight pipe 26*a* is heated up to a designated temperature such as 80° C. The temperature of the cleaning liquid L is controlled by means of the temperature sensor 30, the power regulator 40 and the CPU 50 in the foregoing manner. The heated cleaning liquid L flows out of the tubular structure 26 through the fluid outlet 25, and is supplied to the cleaning liquid supply nozzles 14 to be jetted therefrom toward the wafers W held in the inner tank 11.

Second Embodiment

The fluid heating apparatus in a second embodiment of the present invention will be described with reference to FIGS. 4A, 4B, 5A and 5B.

In the second embodiment of the fluid heating apparatus 20A, the tubular structure 26A comprises a single pipe 70, which is wound in a spiral configuration around the heating lamp 23 to be in a form of a tube. The tubular structure 26A surrounds the halogen lamp 23 with an annular gap being formed between the halogen lamp 23 and the tubular structure 26A. The spiral axis of the pipe 70 coincides with the longitudinal axis of the halogen lamp 23. In view of the heating efficiency, adjacent portions of the pipe 70 with respect to the spiral-axis direction are preferably in close contact with each other, but may be in close proximity while remaining a slight gap therebetween as long as leakage of radiant light emitted from the halogen lamp 23 to the exterior of the tubular structure 26A can be prevented or suppressed to a negligible level. The pipe 70 has one end portion thereof serving as a fluid inlet 24 of the tubular structure 26A and extending straightly through the end cap 22*a*, and the other end portion thereof serving as a fluid outlet 25 of the tubular structure 26A and extending straightly through the end cap 22*b*.

The cross-sectional structure of the spiral pipe 70 is essentially the same as that of the straight pipe 26*a* in the first embodiment, and thus the description thereof is omitted. Also in the second embodiment, the cleaning liquid L flown into the tubular structure 26A through the fluid inlet 24 is heated by the radiant light emitted from the halogen lamp in a manner essentially the same as that in the first embodiment, and flows out of the tubular structure 26A through the fluid outlet 25. In FIGS. 4A, 4B, 5A and 5B, the elements designated by the same reference numerals in FIGS. 1, 2, 3A and 3B are the same as those in FIGS. 1, 2, 3A and 3B, and thus the description thereof is omitted.

Although the foregoing description has been made for embodiments in which the fluid heating apparatus is applied to a semiconductor wafer cleaning system, the fluid heating apparatus may be applied to a cleaning system for cleaning a process object other than a semiconductor wafer, such as a glass substrate for an LCD (liquid crystal display). The fluid to be heated by the fluid heating apparatus is not limited to DHF, or a fluid in liquid state. The fluid may be a gaseous fluid or a misty fluid.

Third Embodiment

FIGS. 6A, 6B, 7A and 7B show an IPA drying system for drying semiconductor wafers by using a mixed gas of IPA vapor and $N_2$ gas, which is equipped with a fluid heating apparatus 20B in the third embodiment of the present invention. The IPA drying system includes: a process container 80 adapted to accommodate semiconductor wafers W (i.e., process objects) therein; a fluid supply nozzle 81 for jetting a mixed gas of IPA vapor and $N_2$ gas toward the semiconductor wafers W accommodated in the process container 80; a fluid heating apparatus 20B in a third embodiment according to the present invention; and a two-fluid nozzle 82 for atomizing IPA liquid by using $N_2$ gas.

The fluid heating apparatus 20B in the third embodiment differs from the fluid heating apparatus 20A in the second embodiment only in the following respects.

First, the cross-sectional structure of the spiral pipe 70A of the fluid heating apparatus 20B is different from that of the spiral pipe 70 of the fluid heating apparatus 20A. The spiral pipe 70A has a single-layer structure, and comprises a stainless pipe which itself has a good thermal conductivity. As IPA is not corrosive, the provision of an inner layer made of a chemical resistant synthetic resin is not necessary (but may be provided). The black paint 27 is coated on the stainless pipe (see FIG. 7B). One end of the spiral pipe 70A serving as a fluid inlet 24 of the tubular structure is connected to an outlet port 83 of the two-fluid nozzle 82.

Second, the tubular container 21 of the fluid heating apparatus 20B is further provided at the end cap thereof with a purge gas supply port 86. $N_2$ gas (i.e., inert gas) is supplied into the tubular container 21 through the purge gas supply port 86, whereby the interior of the tubular container 21 can be purged, preventing a flammable or volatile fluid (such as IPA vapor) from penetrating into the interior of the tubular container 21, achieving a safer operation of the fluid heating apparatus 20B.

In operation, a mixed fluid of atomized IPA and $N_2$ gas flows into the spiral pipe 70A of the fluid heating apparatus 20B, where the atomized IPA is vaporized, and thus a mixed gaseous fluid of IPA vapor and $N_2$ gas flows out of the fluid heating apparatus 20B. The mixed gaseous fluid of IPA vapor and $N_2$ gas is supplied to the fluid supply nozzle 81 and is jetted therefrom toward the semiconductor wafers W to dry the same. Also in this embodiment, the fluid heating apparatus 20B is capable of heating a fluid efficiently.

In FIGS. 6A, 6B, 7A and 7B, the elements designated by the same reference numerals in FIGS. 4A, 4B, 5A and 5B are the same as those in FIGS. 4A, 4B, 5A and 5B, and thus the description thereof is omitted.

The third embodiment may be modified by substituting the tubing structure comprising plural straight pipes 20*a* of the first embodiment with the spiral pipe 70A of the tubing structure 20B.

Two or more fluid heating apparatuses 20B may be connected in series. In this case, the upstream-side fluid heating apparatus 20B may heat the fluid to vaporize the same, and the downstream-side fluid heating apparatus 20B may heat the vaporized fluid to a designated process temperature.

In the foregoing embodiments, the halogen lamp 23 may be replaced with another sort of thermal-radiating lamp, such as an infrared lamp.

The invention claimed is:

1. A fluid heating apparatus comprising:

a heating lamp;

a tubular structure having a fluid inlet allowing fluid to be heated to flow into the tubular structure and a fluid outlet allowing the fluid having been heated to flow out of the tubular structure, wherein the tubular structure comprises at least a single pipe wound in a spiral configuration around the heating lamp, and wherein at least a surface, facing the heating lamp, of the tubular structure is coated with a radiant-light-absorbing paint; and a mixing device configured to mix an inert gas and a volatile liquid to form a mixed fluid containing the inert gas and the volatile liquid as atomized, and wherein the tubular structure is connected to the mixing device so that the mixed fluid is supplied to the tubular structure and the atomized volatile liquid is heated in the tubular structure to be vaporized.

2. The fluid heating apparatus according to claim 1, wherein each of said at least a single pipe has an inner surface formed of a chemical-resistant synthetic resin.

3. The fluid heating apparatus according to claim 2, wherein each of said at least a single pipe has a heat-conductive layer formed of a heat-conductive material, and the radiant-light-absorbing paint is coated on the heat-conductive layer.

4. The fluid heating apparatus according to claim 1, further comprising a tubular container accommodating the heating lamp and the tubular structure.

5. The fluid heating apparatus according to claim 4, wherein the tubular container has a light-reflective inner surface.

6. The fluid heating apparatus according to claim 4, further comprising an inert gas supply adapted to supply an inert gas into an interior of the tubular container.

7. The fluid heating apparatus according to claim 1, further comprising:

a temperature sensor adapted to detect temperature of a fluid flowing through the tubular structure;

a power supply adapted to regulate electric power to be supplied to the heating lamp, thereby to control calorific power generated by the heating lamp; and a controller configured to generate a control signal based on the temperature detected by the temperature sensor and send the control signal to the power supply so that the temperature of the fluid coincides with a target value.

8. The fluid heating apparatus according to claim 1, wherein the at least a single pipe is formed of a metallic material.

9. The fluid heating apparatus according to claim 8, wherein the metallic material is stainless steel.

* * * * *

UNITED STATES PATENT AND TRADEMARK OFFICE

CERTIFICATE OF CORRECTION

PATENT NO. : 7,593,625 B2
APPLICATION NO. : 11/481253
DATED : September 22, 2009
INVENTOR(S) : Kamikawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 372 days.

Signed and Sealed this

Twenty-first Day of September, 2010

David J. Kappos

David J. Kappos
*Director of the United States Patent and Trademark Office*